US009701518B2

(12) United States Patent
Rosenström et al.

(10) Patent No.: US 9,701,518 B2
(45) Date of Patent: Jul. 11, 2017

(54) METHOD, APPARATUS AND COMPUTER PROGRAM FOR MOVING A CONTAINER CARRIER

(71) Applicant: Cargotec Finland Oy, Tampere (FI)

(72) Inventors: Jussi Rosenström, Kangasala (FI); Jeroka Alanko, Pirkkala (FI); Esa Parta, Tampere (FI); Jouni Vesala, Tampere (FI)

(73) Assignee: Cargotec Finland OY (FI)

( * ) Notice: Subject to any disclaimer, the term of this patent is extended or adjusted under 35 U.S.C. 154(b) by 0 days.

(21) Appl. No.: 14/647,182

(22) PCT Filed: Dec. 11, 2012

(86) PCT No.: PCT/FI2012/051224
§ 371 (c)(1),
(2) Date: May 26, 2015

(87) PCT Pub. No.: WO2014/091057
PCT Pub. Date: Jun. 19, 2014

(65) Prior Publication Data
US 2015/0307329 A1 Oct. 29, 2015

(51) Int. Cl.
*B66C 9/04* (2006.01)
*B66C 19/00* (2006.01)

(52) U.S. Cl.
CPC ..... *B66C 9/04* (2013.01); *B66C 19/005* (2013.01); *B66C 19/007* (2013.01)

(58) Field of Classification Search
CPC ..... B66C 9/04; B66C 19/007; B66C 19/002; B66C 19/005
See application file for complete search history.

(56) References Cited

U.S. PATENT DOCUMENTS 5,180,070 A * 1/1993 Feider ..... B62D 7/026 180/415
5,967,348 A * 10/1999 Jussila ..... B62D 7/09 180/264

(Continued)

FOREIGN PATENT DOCUMENTS

CN 2517723 Y 10/2002
CN 102229402 A 11/2011

(Continued)

OTHER PUBLICATIONS

International Search Report and the Written Opinion of the International Searching Authority: Application No. PCT/FI2012/051224, mailed Aug. 6, 2013—(3) pages.

(Continued)

*Primary Examiner* — Kaitlin Joerger
(74) *Attorney, Agent, or Firm* — Boyle Fredrickson, SC

(57) ABSTRACT

The invention relates to container carriers that are used in ports and terminals. The invention comprises a method, an apparatus and a computer program product for moving a container carrier. The method comprises the steps of lowering the container, causing to disengage the weight of the container and the spreader off the wheels, tuning the wheels to an orientation suitable for a carousel or skew maneuver, lifting the container and starting a carousel or skew maneuver.

17 Claims, 5 Drawing Sheets

(56) References Cited

U.S. PATENT DOCUMENTS

| | | | | |
|---|---|---|---|---|
| 6,206,127 | B1 * | 3/2001 | Zakula, Sr. | B62D 7/026 180/234 |
| 7,252,299 | B2 * | 8/2007 | Wierzba | B62D 7/142 212/270 |
| 7,350,840 | B2 * | 4/2008 | Franzen | B66C 19/007 294/81.4 |
| 8,831,841 | B2 * | 9/2014 | Mognon | B66C 9/04 180/24.03 |
| 2006/0180375 | A1 | 8/2006 | Wierzba et al. | |
| 2008/0206027 | A1 * | 8/2008 | Manzi | B66C 19/007 414/349 |
| 2011/0108347 | A1 | 5/2011 | Wierzba et al. | |

FOREIGN PATENT DOCUMENTS

| | | | |
|---|---|---|---|
| EP | 1873112 | A1 | 1/2008 |
| JP | 11310386 | A | 9/1999 |

OTHER PUBLICATIONS

Extended European Search Report dated Jul. 5, 2016: Application No. 12889943.2—(9) pages.

* cited by examiner

METHOD, APPARATUS AND COMPUTER PROGRAM FOR MOVING A CONTAINER CARRIER

CROSS-REFERENCE TO RELATED APPLICATIONS

This application claims priority to International Application No. PCT/FI2012/051224, filed on Dec. 11, 2012, the entire contents of which are incorporated herein by reference.

FIELD OF THE INVENTION

The invention relates to container carriers in ports and terminals. More specifically, the invention relates to a method, apparatus and computer program for moving a rubber-tired container carrier.

BACKGROUND OF THE INVENTION

Shuttle carriers, straddle carriers, sprinter carriers, runner carriers and transporting carriers are used in ports for moving containers between port cranes and a storage area.

Those container carriers move freely while carrying the container in the cargo area; thus, they need to be able to move flexibly also in areas of little space. Carriers can move in a rotational movement around a rotation axis or in a skew movement in a diagonal or straight direction.

The turning of the carriers can he challenging. Carriers often have to drive a U-shaped path to be able to turn a container for 180 degrees. A problem of conventional container handling vehicles is thus the difficulty of maneuvering in tight places and achieving exactly the desired position and orientation. It is important to position a container in the right way, amongst others to ensure the accessibility of the door at the end of the container.

To solve the problem of turning of containers in tight places, a method of turning a carrier such as a straddle carrier or transporting carrier around its own center point has been introduced. This method, a so-called carousel maneuver, has been introduced. With the method, the container can be turned at a desired angle. One idea of the method is to turn the front wheels and the rear wheels at an angle enabling a turn around the center axis of the vehicle. In order to rotate counterclockwise about the center axis of the carrier, the driving direction of the left side front and rear wheels is reversed while the right side front and rear wheels remain going forward. For clockwise rotation, consequently, the left side front and rear wheels spin forward while the motion of the right side front and rear wheels is reversed. The carousel maneuver is for example mentioned in US20110108347.

There are, however, some challenges in the implementation of turning a container carrier's wheels to begin a turning or skew movement. A loaded container can weigh between 20 and 40 tons. This puts an enormous stress on the turning mechanism of the wheels of the carrier and makes the turning of the wheels more difficult. A great force is needed to turn the wheels while the carrier is carrying the container. Turning the wheels while the container is being carried also increases wear of the tires resulting in the frequent need to change the tires. Additionally, carrier's wheels are often turned on the same spot of the cargo area, resulting in wear of the ground surface on the spot.

The aim of this invention is to facilitate the process of maneuvering a container carrier, thus resulting in less wear of the carrier's components and the ground surface.

SUMMARY OF THE INVENTION

A purpose of the invention is to facilitate the moving of a. container carrying apparatus, such as a carrier. The invention discloses a method for moving a container carrier comprising; lowering the container, causing to disengage the weight of the container off the wheels, turning the wheels to an orientation suitable for a carousel or skew maneuver, lifting the container, and starting a carousel or skew maneuver. When the container is lowered. and its weight disengages off the wheels, also the weight of the spreader carrying the container disengages off the wheels. This again reduces the strain on the wheels, steering mechanics and the ground.

In one embodiment, the method comprises stopping the carousel or skew maneuver when the container has been turned at a predetermined angle. A predetermined angle is an angle that has been determined beforehand, for example by a user through a user interface, by turning a steering wheel or by entering a value, or that has been calculated by the port or crane automation system.

In one embodiment, the method comprises lowering the container, causing to disengage the weight of the container off the wheels, and turning the wheels to an orientation aligned with the longitudinal axis of the carrier and subsequently lifting the container again so that the carrier is ready to continue movement.

In one embodiment, the method comprises receiving a command to begin the carousel or skew maneuver. The command to initiate the maneuver can be sent from a user interface In response to the user action or it may be sent from the crane or port automation system.

In one embodiment, the method comprises receiving a command to stop the carousel or skew maneuver and to turn. the wheels to an orientation aligned with the longitudinal axis of the carrier. The angle can deviate from the longitudinal axis to some extent. It is, however, important that all wheels deviate in the same direction.

Another aspect of the invention discloses an apparatus for moving a container carrier, the apparatus being arranged to perform at least: lowering the container, causing to disengage the weight of the container off the wheels, turning the wheels to an orientation suitable for a carousel or skew maneuver, lifting the container, starting a carousel or skew maneuver.

One embodiment of the invention discloses an apparatus for moving a container carrier, characterized by means for performing: lowering the container, causing to disengage the weight of the container off the wheels, turning the wheels to an orientation suitable for a carousel or skew maneuver, lifting the container, starting a carousel or skew maneuver.

In one embodiment, the apparatus is arranged to perform: stopping the carousel or skew maneuver when the container has been turned at a predetermined angle.

In one embodiment, the apparatus is arranged to perform: lowering the container, causing to disengage the weight of the container off the wheels, and turning the wheels to an orientation aligned with the longitudinal axis of the carrier and subsequently lifting the container again so that the carrier is ready to continue movement.

In one embodiment, the apparatus is arranged to perform: receiving a command to begin the carousel or skew maneuver.

In one embodiment, the apparatus is arranged to perform: receiving a command to stop the carousel or skew maneuver and to turn the wheels to an orientation aligned with the longitudinal axis of the carrier.

Another aspect of the invention discloses a computer program product for turning a container carrier comprising a computer-readable medium bearing computer program code, the computer program code comprising: code for lowering the container, causing to disengage the weight of the container off the wheels, code for turning the wheels to an orientation suitable for a carousel or skew maneuver, code for lifting the container, code for starting a carousel or skew maneuver.

In one embodiment of the computer program product, the computer program product comprises code for stopping the carousel or skew maneuver when the container has been turned at a predetermined angle.

In one embodiment of the computer program product, the computer program product comprises code for lowering the container, causing to disengage the weight of the container of the wheels, and for turning the wheels and subsequently lifting the container again so that the carrier is ready to continue, movement.

In one embodiment of the computer program product, the computer program product comprises code for receiving a command to begin the carousel or skew maneuver.

In one embodiment of the computer program product, the computer program product comprises code for receiving a command to stop the carousel or skew maneuver and to turn the wheels to an orientation aligned with the longitudinal axis of the carrier.

The invention improves the problems of the container carrier moving process. Because the weight of the container does not rest on the wheels in the wheel turning process, it is easier to turn the wheels. This results in less stress on the wheel turning mechanics, less wear of the tires and less wear of the ground material, for example asphalt surface.

By reducing the turning radius of a container carrier, it is easier for a carrier to maneuver in a port area with obstacles and other vehicles. This simplifies the control of an automated port and routing of the container carriers. The possibility of collisions is significantly reduced as container carriers may choose the optimal path to destination.

BRIEF DESCRIPTION OF THE DRAWINGS

The accompanying drawings, which are included to provide a further understanding of the invention and constitute a part of this specification, illustrate embodiments of the invention. In the drawings.

DETAILED DESCRIPTION OF THE INVENTION

Figure 1:
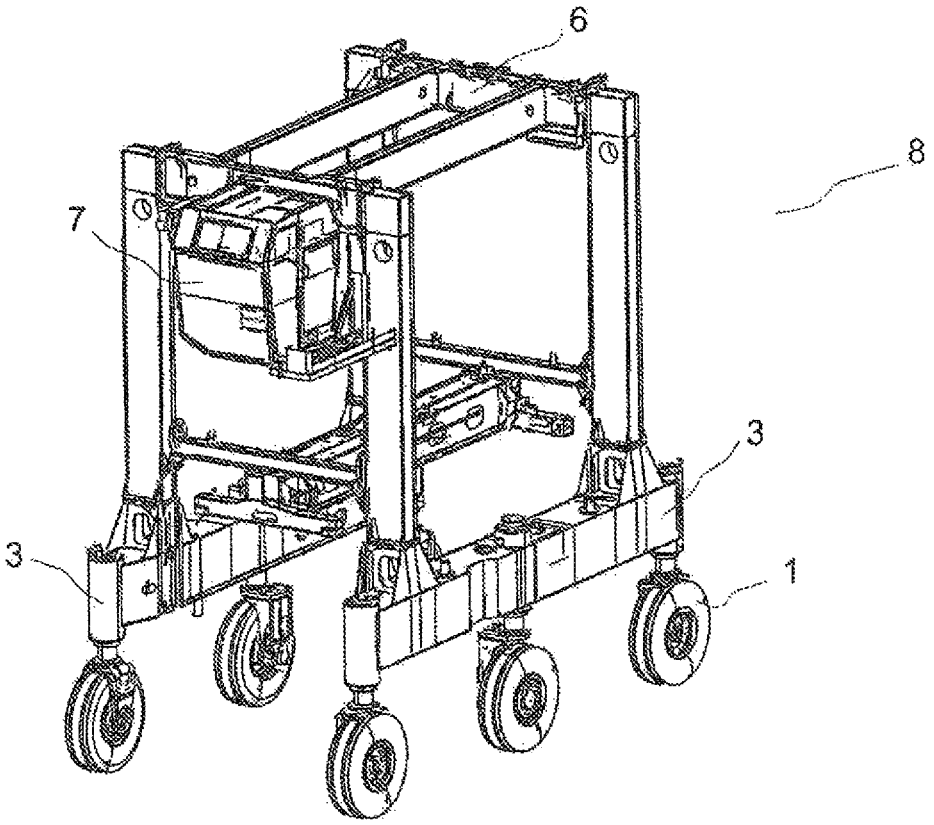
FIG. 1 is a perspective view of a container carrier according to the invention.

FIG. 1 shows a perspective view of a container carrier such as a straddle carrier. A container carrier as shown has a left side that comprises a front wheel close to a first end of the apparatus' frame and a rear wheel close to a second end of the apparatus' frame, and opposite to the left side a right side that has a front wheel opposite to the front wheel of the left side and a rear wheel opposite to the rear wheel of the left side. The wheels 1 of the container carrier which usually have rubber tires are attached from their axis to the beam 3 that connects them in a way that they can be rotated in respect to a longitudinal direction, which is the direction of the line connecting a front wheel and a rear wheel. In this case, the carrier has three wheels on each side in FIG. 1, there can also be seen top beams 6 of the container carrier and a cabin 7.

The crane or carrier then comprises one vertical bar on each side that connects the horizontal bar connecting the wheels with a horizontal bar or horizontal bars 6 on top of the carrier o crane, A lifting apparatus is connected to this at least one horizontal bar 6 on top of the carrier or crane, which lifting apparatus is able to lift at least one container off the ground.

Additionally, a container carrier usually comprises a cabin 7 for the driver.

The illustrated container carrier is a straddle carrier. However, a container carrier according to the invention can also be a shuttle carrier, sprinter carrier or transporting carrier.

Figure 2:
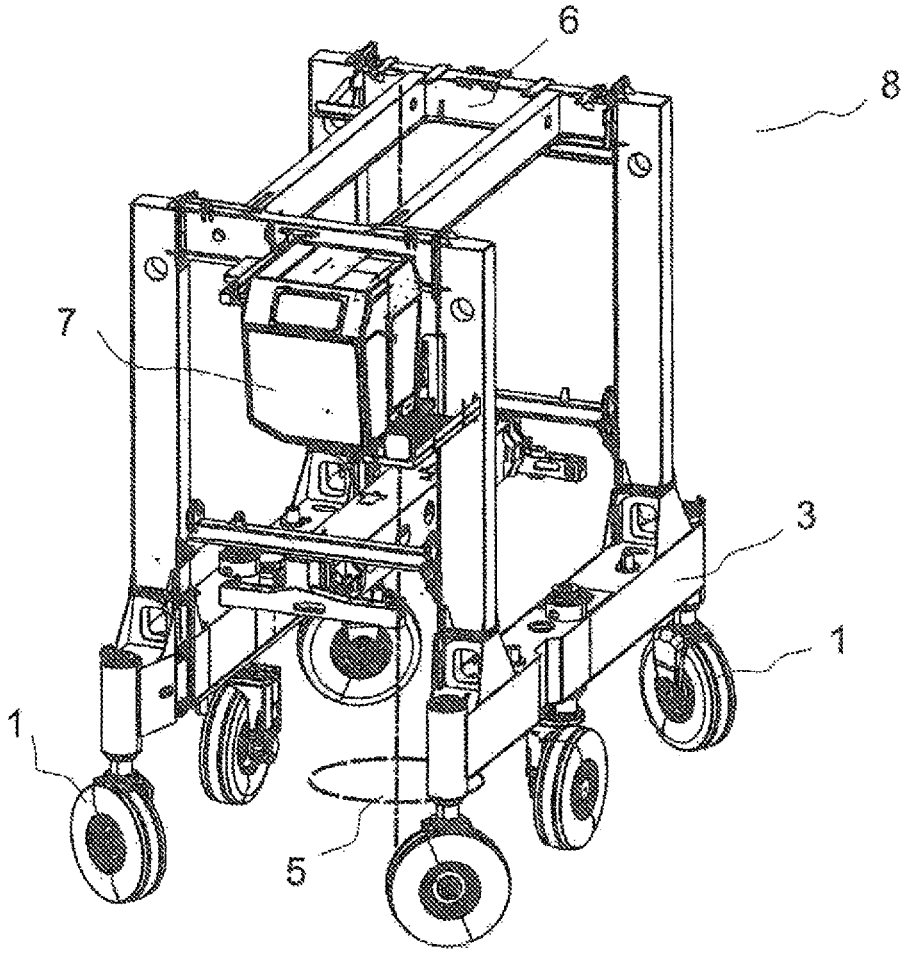
FIG. 2 is a perspective view of a container carrier according to the invention with the wheels turned at an angle suitable for the carousel maneuver.

In FIG. 2 is depicted a perspective view of the straddle carrier of FIG. 1 with the wheels 1 oriented in a way to enable a carousel maneuver of the carrier around its center axis. In the figure, a vertical, the center axis 5 is depicted. The axis 5 is the center axis of the entire carrier. The coordinate of the center axis of the crane or carrier 5 in a longitudinal direction that is usually aligned with the side beams is the middle point between the front wheel and the rear wheel. Often, the midpoint in the longitudinal direction lies between two center wheels of the vehicle. In a transverse direction, the center point is situated in the middle between the left and right side of the carrier or crane. In order to achieve a rotating radius that is as small as possible, the carrier needs to rotate around the mentioned center axis.

In the figure, a small deviation of the rotation axis from the center axis is depicted by a circle around the axis.

Figure 3:
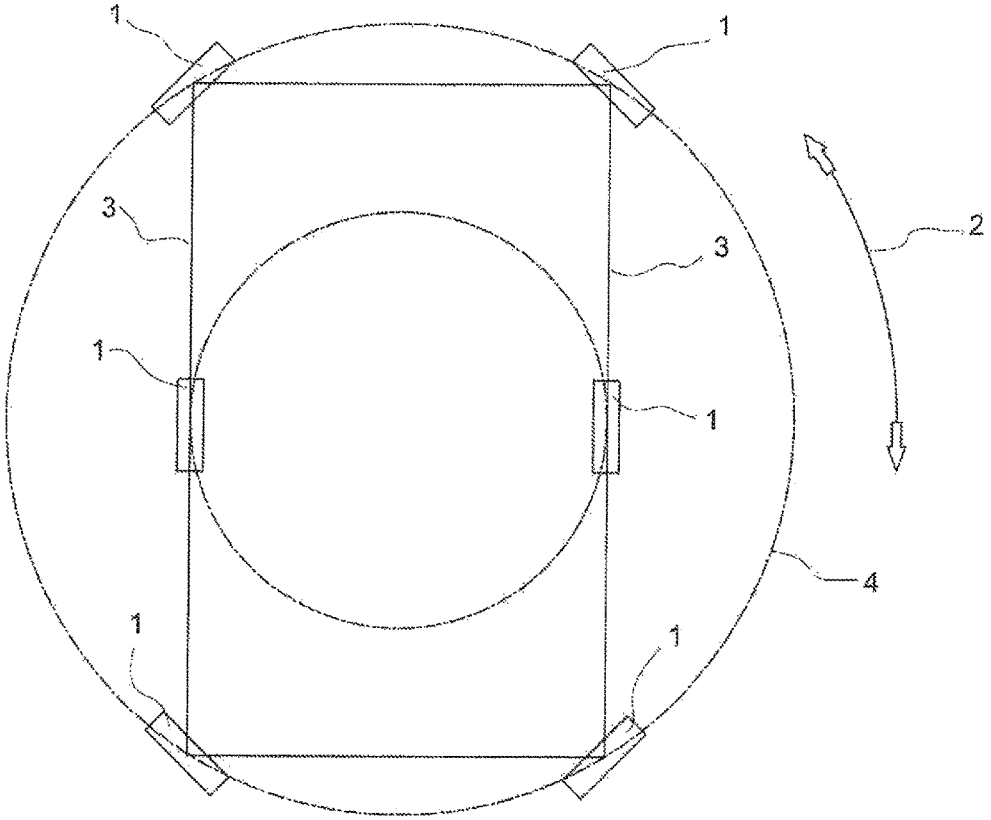
FIG. 3 is a schematic top view of a carousel turning movement of a carrier.

In FIG. 3, a schematic top view of a carousel turning movement of a carrier according to the invention is shown. In this embodiment, the carrier has six wheels 1. The wheels are attached to the side beams 3 of the carrier. The front wheels and the back wheels define the smallest possible turning radius 4. It is, however, possible that the carrier structure has parts protruding outwards further than the wheels. In this case, the carrier will need more space for turning than the turning radius defined by the wheels. The direction of the turning motion 2 can be clockwise or counterclockwise.

At the beginning of this embodiment of a carousel maneuver, each wheel 1 of the carrier turns to a direction such that it forms a tangent to the center axis f of the carrier. In order to now turn around the center axis 5 without driving forward or backward, the driving direction of the left side front and rear wheels is reversed while the right side front and rear wheels remain going forward. For clockwise rotation, the left side front and rear wheels spin forward while the motion of the right side front and rear wheels is reversed. The operator or the control system stops the rotational motion when the container carrier has achieved the desired position.

Figure 4:
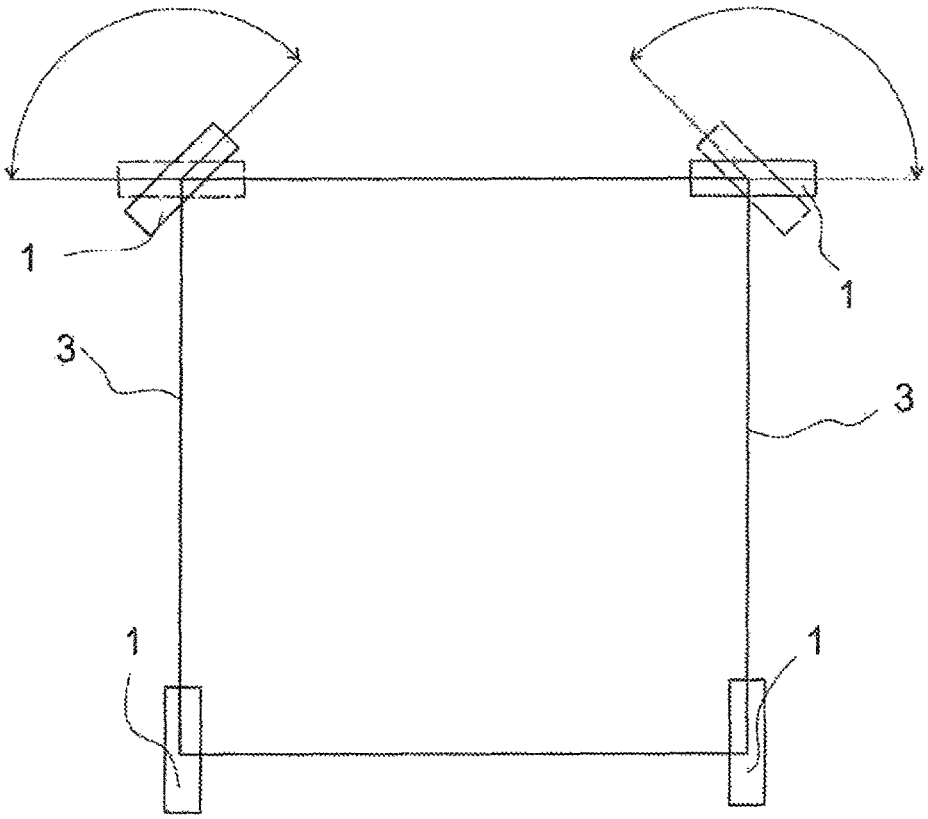
FIG. 4 is a schematic top view of a carousel turning movement of a carrier having four wheels where the carrier rotates around one of the four wheels.

According to one embodiment, the rotation axis in a carousel maneuver is different from the center axis of the carrier. In FIG. 4 is shown an example where a carrier having four wheels rotates around one of its back wheels. In the example, both the left and the right back wheel are in a position aligned with the longitudinal axis of the carrier. In the first example, the left front wheel is turned in a way that it forms a tangent to the center axis. The right wheel is turned at an angle of approximately 90 degrees. This way, the carrier turns around the left back wheel. For the second example, the positions of the front wheels are marked in dashed lines. In the second example, the right front wheel is turned at an angle in a way that it forms a tangent to the center axis. The left front wheel is turned at an angle of approximately 90 degrees. This way, the carrier rotates around the right back wheel. Similarly, the carrier can rotate around the left front wheel or around the right front wheel when the wheels have been turned to respective positions.

Figure 5:
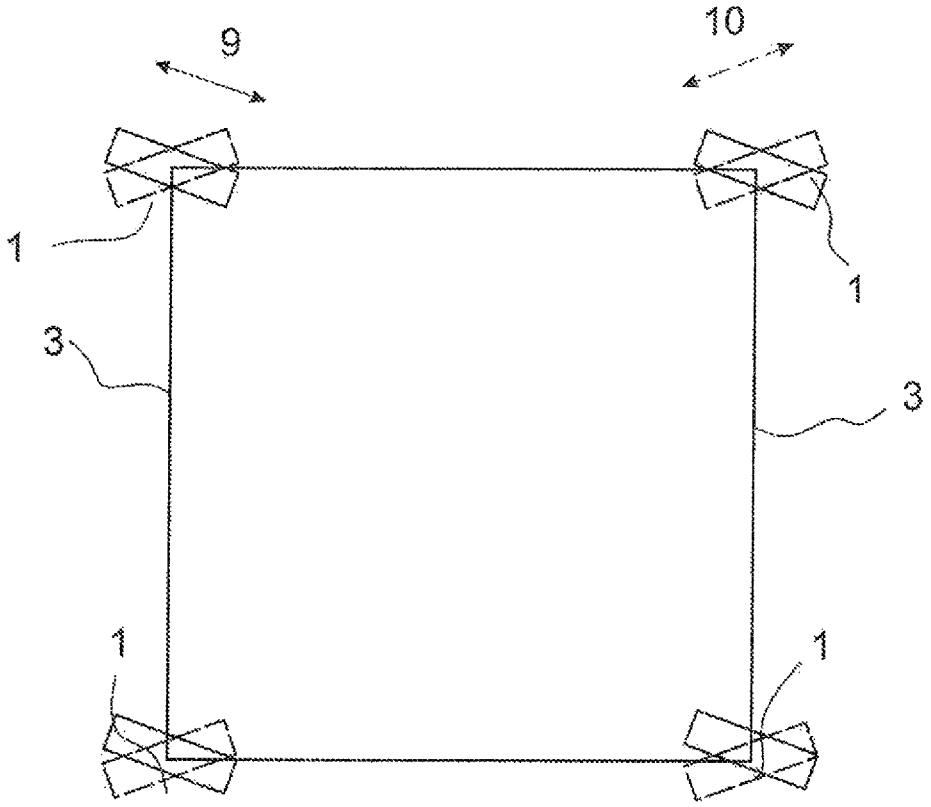
FIG. 5 is a schematic top view of a skew maneuver of a carrier.

In FIG. 5, a skew maneuver of a carrier is shown. For a skew maneuver, all wheels turn at the same angle to enable a motion of the carrier to the side or to a diagonal direction. In one example, the wheels are turned at an angle of approximately 70 degrees on the left side; consequently, the carrier will move in a direction indicated by an arrow 9. In a second example, drawn with dashed lines, the wheels are turned at an angle of approximately 70 degrees on the right. Consequently, the carrier moves in a direction indicated by a dashed arrow 10. The wheels can be turned at any other angle supported by the turning mechanics. According to one embodiment, the wheels are turned at an angle larger than 45 degrees.

Although carriers having four and six wheels have been depicted here, a carrier can also have more wheels, for example up to 32.

An apparatus according to the invention includes a control system for the controlling of movement of the carrier. In one example, the control system comprises wheel position sensors for determining the position angles of the wheels. The control system includes a computer, which means a device having a processor and memory, such as a programmable logic (PLC). Inputs from the sensors are communicated to the computer, which executes a computer program based on the inputs and steers actuators such as a motor, pump or cylinder.

The movement of the container carrier in the port can then be steered by a port automation system or by a user through a user interface.

In an only partially automated port, a user interface is included usually in the cabin for the operator to control the movement of the carrier. In an example, the user interface comprises a steering wheel and pedals; in another example, the user interfaces comprises a joystick. According to another implementation, the user interface comprises a button situated inside the operator's cabin or, in case of an automated vehicle, also in another building or cabin. According to another example, the user interface can comprise an operating panel for the user, such as a touch screen or a computer screen. This operating panel can, according to one example, have a Linux-based operating system.

In a fully automated port, the carrier identifies a container to be transported using sensors for example by reading a bar code attached to the container. The automation system then compares the data of the container with container location data in the system in order to determine the destination location and orientation for the container in the port area. Eased on the initial location and orientation of the container and the destination location and orientation, the system calculates the path to drive and the movements of the container carrier, always taking into account obstacles and other vehicles within the port area. The calculated route is transmitted to the vehicle's control system in order for the route to be executed. The route will also include necessary turning maneuvers such as carousel maneuvers.

According to one example, the control system comprises controlling the wheel turning. According to one example, the wheels of a carrier are turned by hydraulic cylinders. The control system takes in the input about the turning angle, for example given by turning a steering wheel or by a number value given, and translates it into movement of the cylinders to achieve the desired angle. The translation of the movement can he implemented in different ways. According to one example, the motion of valves is controlled, which control fluid supply to the cylinders, thus resulting in motion of the cylinders. According to another example, the steering input is measured by a sensor, and the measured. value is sent to an engine control unit that controls a motor affecting a pump. The pump then is supplying fluid to the cylinder, resulting in the motion.

The different parts of the user interface, such as pedals, steering wheel and touch screen, the measurement devices, steering of the valves and the PLC are connected by a bus, such as a CAN- or DeviceNet-bus.

From the user interface or the automation system, the rotating or carousel maneuver according to the invention can be started. Also, a function to stop the rotating maneuver and turn the wheels back to a straight position is included. This function then, according to one example, sends signals to the valves to make the cylinders turn the wheels at the desired angle, the angle being measured by a sensor.

The embodiments of the present invention may be implemented in software, hardware, application logic or a combination of software, hardware and application logic. In an example embodiment, the application logic, software or instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may comprise a computer-readable storage medium that may be any media or means that can contain or store the instructions for use by or in connection with an instruction execution system, apparatus, or device, such as a computer. The exemplary embodiments can store information relating to various processes described herein. This information can be stored in one or more memories, such as a hard disk, optical disk, magneto-optical disk, RAM, and the like. One or more databases can store the information used to implement the exemplary embodiments of the present inventions. The databases can be organized using data structures (e.g., records, tables, arrays, fields, graphs, trees, lists, and the like) included in one or more memories or storage devices listed herein. The processes described with respect to the exemplary embodiments can include appropriate data structures for storing data collected and/or generated by the processes of the devices and subsystems of the exemplary embodiments in one or more databases.

All or a portion of the exemplary embodiments can be conveniently implemented using one or more general purpose processors, microprocessors, digital signal processors, micro-controllers, and the like, programmed according to the teachings of the exemplary embodiments of the present inventions, as will be appreciated by those skilled in the computer and/or software art(s). Appropriate software can be readily prepared by programmers of ordinary skill based on the teachings of the exemplary embodiments, as will be appreciated by those skilled in the software art. In addition, the exemplary embodiments can be implemented by the preparation of application-specific integrated circuits or by interconnecting an appropriate network of conventional component circuits, as will be appreciated by those skilled in the electrical art(s). Thus, the exemplary embodiments are not limited to any specific combination of hardware and/or software.

If desired, the different functions discussed herein may be performed in a different order and/or concurrently with each other.

Furthermore, if desired, one or more of the above-described functions may be optional or may be combined. Although various aspects of the invention are set out in the independent claims, other aspects of the invention comprise other combinations of features from the described embodiments and/or the dependent claims with the features of the independent claims, and not solely the combinations explicitly set out in the claims.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A method for moving a container carrier, comprising the steps of:

lowering the container, causing to disengage the weight of the container and the spreader off the wheels, turning the wheels to an orientation suitable for a carousel or skew maneuver when the weight of the container and the spreader is disengaged off the wheels, lifting the container, and starting a carousel or skew maneuver.

2. The method according to claim 1, further comprising the step of stopping the carousel or skew maneuver when the container has achieved a predetermined position.

3. The method according to claim 2, wherein the step of lowering the container, disengages the weight of the container off the wheels, and wherein the orientation suitable for the carousel or skew maneuver is an orientation not aligned with a longitudinal axis of the carrier.

4. The method according to claim 1, further comprising the step of receiving a command to begin the carousel or skew maneuver.

5. The method according to claim 1, further comprising the step of receiving a command to stop the carousel or skew maneuver and to turn the wheels to an orientation aligned with the longitudinal axis of the carrier.

6. An apparatus for moving a container carrier, wherein movement of the container carrier is steered by a port automation system, the apparatus comprising:

means for lowering the container, causing to disengage the weight of the container and the spreader off the wheels, means for turning the wheels to an orientation suitable for a carousel or skew maneuver when the weight of the container and the spreader is disengaged off the wheels, means for lifting the container, and means for starting a carousel or skew maneuver.

7. The apparatus according to claim 6, further comprising means for stopping the carousel or skew maneuver when the container has achieved a predetermined position.

8. The apparatus according to claim 7, wherein the means for lowering the container disengages the weight of the container off the wheels, and the orientation suitable for the carousel or skew maneuver is an orientation aligned with the longitudinal axis of the carrier.

9. The apparatus according to claim 6, further comprising means for receiving a command to begin the carousel or skew maneuver.

10. The apparatus according to claim 6 further comprising means for receiving a command to stop the carousel or skew maneuver and to turn the wheels to an orientation aligned with the longitudinal axis of the carrier.

11. A non-transitory computer-readable medium bearing instructions for moving a container carrier, the instructions executable on a processor to:

lower the container, causing to disengage the weight of the container and the spreader off the wheels, turn the wheels to an orientation suitable for a carousel or skew maneuver when the weight of the container and the spreader is disengaged off the wheels, lift the container, and start a carousel or skew maneuver.

12. The non-transitory computer-readable medium according to claim 11, the instructions further executable on the processor to stop the carousel or skew maneuver when the container has achieved the desired position.

13. The non-transitory computer-readable medium according to claim 11, wherein lowering the container, disengages the weight of the container off the wheels.

14. The non-transitory computer-readable medium according to claim 11, the instructions further executable on the processor to receive a command to begin the carousel or skew maneuver.

15. The non-transitory computer-readable medium according to claim 11, the instructions further executable on the processor to receive a command to stop the carousel or skew maneuver and to turn the wheels to an orientation aligned with the longitudinal axis of the carrier.

16. The method according to claim 1, where movement of the container carrier is steered by a port automation system.

17. The non-transitory computer-readable medium according to claim 11, wherein movement of the container carrier is steered by a port automation system.

* * * * *